US010029377B2

(12) United States Patent
Zijlstra et al.

(10) Patent No.: US 10,029,377 B2
(45) Date of Patent: Jul. 24, 2018

(54) HAIR TRIMMING DEVICE

(71) Applicant: KONINKLIJKE PHILIPS N.V., Eindhoven (NL)

(72) Inventors: Marcel Hilco Zijlstra, Leeuwarden (NL); Reinier Alexander Tijssen, Zwolle (NL); Hendrik Jan Mark Van Der Worp, Zwolle (NL); Hendrik Klaas Haagsma, Hoogeveen (NL); Vidyadhar Hanumanthappa, Drachten (NL); Dimitri Peter Heuvel, Enschede (NL); Bastiaan Hendrik De Raat, Harderwijk (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/427,322

(22) PCT Filed: Sep. 18, 2013

(86) PCT No.: PCT/EP2013/069327
§ 371 (c)(1),
(2) Date: Mar. 11, 2015

(87) PCT Pub. No.: WO2014/090429
PCT Pub. Date: Jun. 19, 2014

(65) Prior Publication Data

US 2016/0144518 A1 May 26, 2016

(30) Foreign Application Priority Data

Dec. 10, 2012 (EP) ..... 12196238

(51) Int. Cl.

| | |
|---|---|
| ***B26B 19/20*** | (2006.01) |
| ***B26B 19/06*** | (2006.01) |
| ***B26B 19/38*** | (2006.01) |

(52) U.S. Cl.
CPC ..... *B26B 19/063* (2013.01); *B26B 19/20* (2013.01); *B26B 19/3846* (2013.01); *B26B 19/3886* (2013.01)

(58) Field of Classification Search
CPC ... B26B 19/20; B26B 19/3886; B26B 19/063; Y10T 403/602; Y10T 403/604; Y10T 403/32426

(Continued)

(56) References Cited

U.S. PATENT DOCUMENTS 2,618,060 A 11/1952 Giorgi
2,941,293 A * 6/1960 Mazzoni ..... B26B 19/20 30/201

(Continued)

FOREIGN PATENT DOCUMENTS

CN 203973581 U 12/2014
EP 1510305 A1 3/2005

(Continued)

*Primary Examiner* — Andrea Wellington
*Assistant Examiner* — Fernando Ayala

(57) ABSTRACT

The present application relates to a hair trimming device (10). The hair trimming device has a body (11) with a cutting blade assembly (20). A cutting guide (40) is provided on the body and the position of the cutting guide is adjustable relative to the cutting blade assembly to provide a cutting distance from a user's skin to enable hair to be cut to a desired length. A locking unit (60) is also provided to lock the cutting guide at a desired position relative to the cutting blade assembly. The locking unit comprises a first locking element (64), a second locking element (65) and at least one receiving recess (83). The first and second locking elements are alternately locatable in the or one of the receiving recesses when the position of the cutting guide is adjusted relative to the cutting blade assembly to lock the cutting guide at different positions.

15 Claims, 4 Drawing Sheets

(58) Field of Classification Search
USPC ..... 30/77, 200, 196–198, 293
See application file for complete search history.

(56) References Cited

U.S. PATENT DOCUMENTS

| | | | | | |
|---|---|---|---|---|---|
| 3,287,805 | A * | 11/1966 | Du Charme | B26B 19/20 | 30/202 |
| 3,897,647 | A * | 8/1975 | Black | A01K 85/00 | 24/115 F |
| 4,669,189 | A | 6/1987 | Ullmann | | |
| 5,102,173 | A * | 4/1992 | Schallern | E05B 65/0888 | 292/288 |
| 5,259,115 | A | 11/1993 | Bluder et al. | | |
| 5,604,985 | A | 2/1997 | Andis et al. | | |
| 5,979,060 | A * | 11/1999 | Holzbauer | B26B 19/20 | 30/200 |
| 6,079,103 | A * | 6/2000 | Melton | B26B 19/20 | 30/43.92 |
| 2002/0095793 | A1* | 7/2002 | Wilcox | B26B 19/20 | 30/201 |
| 2003/0233754 | A1* | 12/2003 | Braun | B26B 19/20 | 30/201 |
| 2006/0123633 | A1* | 6/2006 | Hauer | B26B 19/20 | 30/201 |
| 2008/0282550 | A1 | 11/2008 | Piwaron | | |
| 2010/0083508 | A1* | 4/2010 | Cheng | B26B 19/20 | 30/201 |
| 2012/0233865 | A1* | 9/2012 | Kammer | B26B 19/3846 | 30/201 |

FOREIGN PATENT DOCUMENTS

| | | | |
|---|---|---|---|
| EP | 1880811 | B1 | 3/2010 |
| WO | 03033222 | A1 | 4/2003 |
| WO | 2008028332 | A1 | 3/2008 |
| WO | 2008099281 | A2 | 8/2008 |

* cited by examiner

HAIR TRIMMING DEVICE

CROSS-REFERENCE TO PRIOR APPLICATIONS

This application is the U.S. National Phase application under 35 U.S.C. § 371 of International Application No. PCT/EP2013/069327, filed on Sep. 18, 2013, which claims the benefit of European Application No. 12196238.5, filed on Dec. 10, 2012. These applications are hereby incorporated by reference herein.

FIELD OF THE INVENTION

The present application relates to a hair trimming device.

BACKGROUND OF THE INVENTION

Grooming devices exist for cutting body and facial hair. Such devices are known as 'trimmers' or hair trimming devices and typically comprise a set of fixed blades and an adjacent set of moving blades that oscillate from side to side relative to the fixed blades to sever hair protruding between the two sets of blades. When using such devices, it can be difficult for a user to trim hair, especially facial hair, with precision in order to achieve a desired hair length.

One way of achieving a desired hair length is to use interchangeable combs. Such combs, also known as cutting guides, act as a spacer to space the blades from a user's skin. Such a comb has a guide surface which is positionable against a user's skin to determine the trimming length. Therefore, when the comb is moved along a user's skin then the hair can be cut to a set length.

One problem with using interchangeable combs is that different combs are required to provide different hair lengths. Therefore, it is known to provide a comb which is mountable to the body of a hair trimming device and is movable relative to the body so that the distance between the blades and the guide surface is variable.

However, it is difficult to accurately determine the trimming length with an adjustable comb.

SUMMARY OF THE INVENTION

It is an object of the invention to provide a hair trimming device which substantially alleviates or overcomes the problems mentioned above, amongst others.

According to the present invention, there is provided a hair trimming device comprising a body with a cutting blade assembly, a cutting guide on the body, the position of the cutting guide being adjustable relative to the cutting blade assembly to provide a cutting distance from a user's skin to enable hair to be cut to a desired length, and a locking unit to lock the cutting guide at a desired position relative to the cutting blade assembly, wherein the locking unit comprises a first locking element, a second locking element and at least one receiving recess, the first and second locking elements being movable relative to each other to alternately locate in the or one of the receiving recesses when the position of the cutting guide is adjusted relative to the cutting blade assembly to lock the cutting guide at different positions.

With the above arrangement, it is possible to double the number of discrete locking positions of the cutting guide relative to the cutting blade assembly. In particular, it is possible to provide twice the number of locking positions for every receiving recess. This enables the locking unit to have receiving recesses and locking elements of an adequate size to provide rigidity of the locking unit. It is also possible to maintain a spacing between the receiving recesses whilst reducing the distance between discrete locking positions.

The locking unit may comprise a plurality of receiving recesses. The first and second locking elements may be alternately locatable in the receiving recesses as the position of the cutting guide is adjusted relative to the cutting blade assembly.

With this arrangement it is possible to provide a large number of discrete locking positions.

A ridge may be formed between adjacent receiving recesses; the first and second locking elements may be alternately locatable on one of the ridges when the other of the first and second locking elements is received in one of the receiving recesses.

With the above arrangement, it is possible to maintain a rigid divide between the receiving recesses whilst reducing the distance between discrete locking positions.

The plurality of receiving recesses may be disposed in an array along the path of the cutting guide relative to the cutting blade assembly.

The first and second locking elements may be adjacent to each other and may be alternately receivable in the or each receiving recess as the position of the cutting guide is adjusted relative to the cutting blade assembly to lock the cutting guide at different positions. One advantage of this arrangement is that the size of the locking unit is minimized.

The first and second locking elements may be spaced from each other and may be alternatively receivable in different receiving recesses as the position of the cutting guide is adjusted relative to the cutting blade assembly to lock the cutting guide at different positions. One advantage of this arrangement is that the locking elements cannot abut against each other. Furthermore, failure of one locking element should not result in failure of the other locking element because the locking elements are spaced from each other.

The first and second locking elements may be received in an aperture. An urging unit may act on the first and second locking elements to urge the first and second locking elements to protrude from the aperture. The or each receiving recess may oppose the mounting face.

With the above arrangements, the locking elements are urged to maintain the locking unit in a locked condition. Therefore, the cutting guide is restricted from moving when the hair trimming device is in use.

The hair trimming device may further comprise a release unit configured to selectively urge the first and second locking elements out of the or each receiving recess.

With this arrangement it is possible to disengage the locking unit. Therefore, it is simple to adjust the position of the cutting guide relative to the cutting blade assembly to lock the cutting guide at different positions.

The release unit may comprise a release face configured to act on the first and second locking elements. The release unit may be movable between an operating position in which the release face acts on the first and second locking elements to urge the first and second locking elements out of the or each receiving recess and a retracted position.

The release face of the release unit may extend level with or recessed from a base of the or each receiving recess when the release unit is in the retracted position. This provides a means for the locking elements to be securely received in the or each receiving recess.

The release face may have one or more alignment elements formed thereon. The alignment elements may be protuberances or indents formed on the release face. The above arrangements provide a tactile feedback to a user. This provides a means for a user to accurately determine the position of the cutting guide. Furthermore, the locking elements may be easily aligned with the or each receiving recess.

The alignment elements may be configured to align one of the locking elements with the at least one receiving recess. Therefore, it is possible to accurately align the locking elements with the or each receiving recesses.

The alignment elements may be configured to allow the locking elements to slide along the release face when the release unit is in its operating position. This means that it is possible to provide feedback to a user without a user having to exert an excessive force to move the cutting guide.

The first and second locking elements may each have a locking section configured to be received in the or each receiving recesses, and a release section against which the release unit is configured to act. The release section may protrude from the locking section.

With the above arrangements, it is possible to easily disengage the locking elements from the receiving recesses.

A portion of the locking section may extend either side of the release section. Therefore, the release unit is able to exert a balanced force on each of the locking elements. Furthermore, the locking elements are urged in the direction of movement.

The first and second locking elements may be on the body portion and the at least one receiving recess may be on the cutting guide. This means that the ease of manufacturing is maximized.

The locking unit may be configured to lock the cutting guide in two or more discrete positions. With the above arrangement, it is possible for the cutting length to be accurately determined.

The two or more discrete positions are spaced equal to or less than 2 mm, preferably about 1 mm. Therefore, it is possible to precisely control the cutting length. These and other aspects of the invention will be apparent from and elucidated with reference to the embodiments described hereinafter.

BRIEF DESCRIPTION OF THE DRAWINGS

Embodiments of the invention will now be described, by way of example only, with reference to the accompanying drawings, in which.

DETAILED DESCRIPTION OF THE EMBODIMENTS

Figure 1:
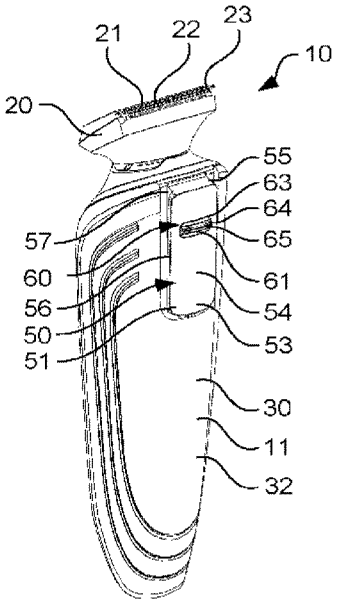
FIG. 1 shows a perspective view of a hair trimming device.
Figure 3:
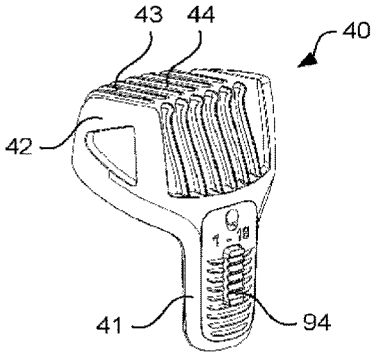
FIG. 3 shows a partial perspective view of a cutting guide of the hair trimming device shown in FIG. 1.

Referring to FIGS. 1 to 5, there is shown a device 10 for cutting and trimming hair, such as, but not limited to, facial or body hair. The hair trimming device 10 comprises a body 11 with a blade portion 20 and a handle portion 30. The blade portion 20 is fixably mounted to one end of the handle portion 30. The blade portion 20, acting as a cutting blade assembly, extends from one end of the handle portion 30. The handle portion 30 is elongate. The handle portion 30 is held by a user during use to orientate and position the hair trimming device 10 against a user's skin. The blade portion 20 is configured to cut hair when the device 10 is operated. The hair trimming device 10 further comprises a cutting guide 40. The cutting guide 40 is provided on the body 11. The cutting guide 40 has a mounting portion 41 and a head portion 42. The cutting guide 40, also known as a comb, extends over the blade portion 20. That is, the head portion 42 extends over the cutting blade assembly 20.

The mounting portion 41 of the cutting guide 40 is secured to the handle portion 30. The head portion 42 extends from the mounting portion 41. The head portion 42 extends over the cutting blade assembly 20. The head portion 42 has a plurality of comb elements 43. The comb elements 43 are spaced from each other so that hair is able to pass between the comb elements 43. Therefore, hair is able to be received by the head portion 42 of the cutting guide 40 and be provided at the blade portion 20 to be trimmed by the blade portion 20. The head portion 42 of the cutting guide 40 has a guide surface 44. The guide surface 44 is arranged to be positioned against a user's face or skin to orientate and position the hair trimming device 10, and therefore the cutting blade assembly relative to the skin. The guide surface 44 of the cutting guide 40 is defined by end surfaces of the comb elements 43. That is end surfaces of the comb elements 43 are aligned with each other to form the guide surface 44. The guide surface 44 of each comb element 43 is spaced from the cutting blade assembly 20 when the cutting guide 40 is detachably secured to the body 11.

In the present embodiment, the cutting guide 40 is detachably secured to the handle portion 30. The cutting guide 40 is configured to slide relative to the handle portion 30 to adjust the desired cutting length. The cutting guide 40 enables a user to accurately trim hair at a predetermined length relative to the skin/body.

The cutting guide 40 is mounted to the handle portion 30 of the body 11 by a mounting unit 50. The mounting unit 50, or guide mechanism, provides a means to slidably attach the cutting guide 40 to the handle portion 30. However, it will be understood that in an alternative embodiment, the cutting guide 40 may be detachably secured to the blade portion 20. The mounting unit 50 comprises a first mounting part 51 on the body 11 and a second mounting part 52 on the cutting guide 40. The first and second mounting parts 51, 52 slidably mount to each other.

A locking unit 60 is provided to lock the cutting guide 40 in position on the handle portion 30. That is, the locking unit 60 is provided to secure the cutting guide 40 in a desired position on the handle portion 30 so that the guide surface 44 is disposed a desired distance from the blade portion 20. The locking unit 60 comprises a first locking part 61 on the body 11 and a second locking part 62 on the cutting guide 40. The first and second locking parts 61, 62 are configured to releasably engage with each other.

When the cutting guide 40 is moved along the body 11 of the hair trimming device 10 and is secured in a desired position, it is possible to set the distance between the cutting blade assembly 20 and a guide surface of the cutting guide 40 to determine the length to which the hair will be trimmed. That is, the cutting guide 40 is slidable along the handle portion 30 to adjust the position of the head portion 42 relative to the blade portion 20 and is securable to the handle portion 30 to fix the fitting guide in a desired position. The mounting unit 50 and the locking unit 60 together form an attachment means or mechanism.

The blade portion 20, acting as a cutting blade assembly, comprises a fixed blade plate 21 and a moving blade plate 22 The moving blade plate 22 lies adjacent to the fixed blade plate 21 and, in use, is driven by a motor (not shown) to oscillate back and forth across the fixed blade plate 21. Each blade plate 21, 22 comprises a plurality of cutting teeth 23. Hair is cut by a shearing action as it protrudes between the teeth 23 of the two blade plates 21, 22 and the moving blade plate 22 oscillates back and forth across the fixed blade plate 21.

The handle portion 30 forms a housing. The handle portion 30 includes a controller for operating the hair trimming device 10, a user input such as one or more buttons (not shown), and a power supply unit. The power supply unit (not shown) is a rechargeable battery although it will be appreciated that a mains operated power supply may be used. The components are received in the housing of the handle portion 30.

The handle portion 30 has an outer surface 32. The first mounting part 51 of the mounting unit 50 is on the outer surface 32. The first mounting part 51 comprises a mounting rail 53. The mounting rail 53 protrudes from the outer surface 32 of the handle portion 30. The mounting rail 53 is integrally formed with the handle portion 30. The mounting rail 53 is elongate and extends parallel to the longitudinal axis of the handle portion 30. The mounting rail 53 has a mounting face 54 and parallel side walls 55. The mounting face 54 extends between the parallel side walls 55. The mounting face 54 is planar. The mounting rail 53 determines the path of the cutting guide 40 along the body 11.

A mounting ridge 56 extends along the length of each side wall 55. The mounting ridges 56 define mounting recesses 57. Each mounting recess 57 is formed between the corresponding mounting ridge 56 and the outer surface 32 of the handle portion 30. The mounting recesses 57 extend parallel to, but spaced from, each other.

Figure 2:
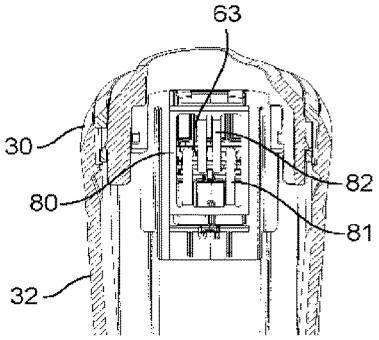
FIG. 2 shows a partial cross-sectional view of a handle portion of the hair trimming device shown in FIG. 1.
Figure 4:
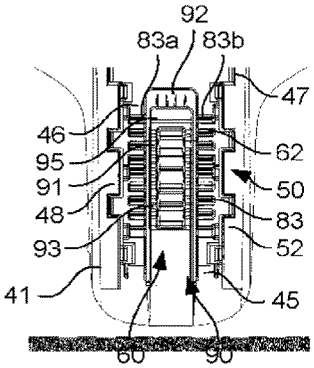
FIG. 4 shows another partial perspective view of the cutting guide shown in FIG. 3.
Figure 5:
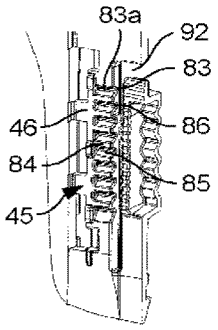
FIG. 5 shows another partial perspective view of the cutting guide shown in FIG. 3.
Figure 6:
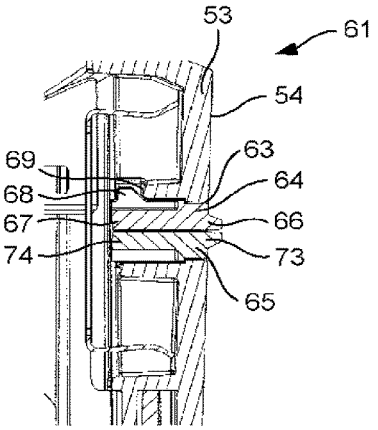
FIG. 6 shows a partial cross-sectional view of a first locking part of a locking unit of the hair trimming device shown in FIG. 1.
Figure 7:
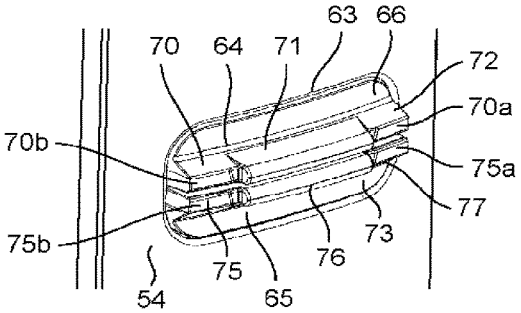
FIG. 7 shows a perspective view of the first locking part of the locking unit shown in FIG. 6.
Figure 8:
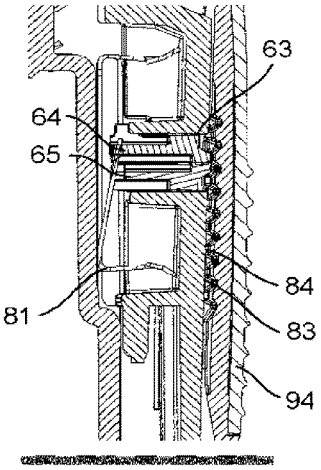
FIG. 8 shows a partial cross-sectional view of the first locking part and a second locking part of the locking unit of the device shown in FIG. 1.
Figure 9:
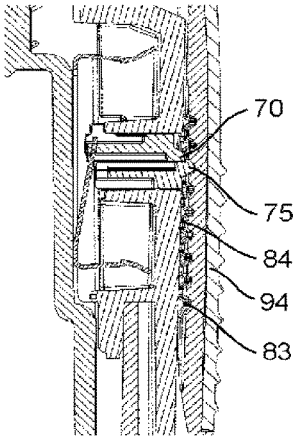
FIG. 9 shows another partial cross-sectional view of the first locking part and the second locking part of the locking unit of the device shown in FIG. 1.

The first locking part 61 of the locking unit 60 extends from the handle portion 30. In the present embodiment, the first locking part 61 is on the first mounting part 51 of the mounting unit 50. An aperture 63 is formed in the mounting face 54. The aperture 63 extends through the mounting rail 53. That is, the aperture 63 extends from the mounting face 54, into the housing of the handle portion 30. A rear view of the aperture 63 is shown in FIG. 2 with part of the housing cut away.

A first locking element 64 and a second locking element 65 are received in the aperture 63. The first and second locking elements 64, 65 form part of the first locking part 61. The first and second locking elements 64, 65 extend from the aperture 63.

The first and second locking elements 64, 65 are disposed adjacent to each other in the aperture 63. Each locking element 64, 65 is slidable along the aperture 63. That is, the aperture 63 defines a passage along which each of the first and second locking elements 64, 65 are slidable. The first and second locking elements 61, 62 are slidable along the aperture 56 independently of each other.

Referring in particular to FIGS. 6 to 9, the first and second locking elements 64, 65 will now be described in detail.

The first locking element 64 has an engaging or front end 66 and a support or rear end 67. The engaging end 66 of the first locking element 64 extends from the aperture 63. That is, during use, the engaging end 66 is arranged to normally protrude from the mounting face 54 of the mounting unit 50. The support end 67 of the first locking element 64 is disposed in the aperture 63. The support end 67 of the first locking element 64 is received between a section of the side surface of the aperture 63 and the second locking element 65. Therefore, the first locking element 64 is supported and guided in the aperture 63. A locating face of the first locking element 64 is configured to locate against a corresponding locating face of the second locking element 65.

A limiter 68 is provided on the support end 67 of the first locking element 64. The limiter 68 is provided to limit movement of the first locking element 64. That is, the limiter 68 is configured to limit the extent the engaging end 66 is able to protrude from the mounting face 54. The limiter 68 abuts against an inner end 69 of the aperture 63 to determine the maximum extension of the first locking element 64 from the mounting face 54. It will be understood that the limiter 68 moves away from the inner end 69 of the aperture 63 when the engaging end 66 of the first locking element 64 is retracted towards the aperture 63. The inner end 69 of the aperture 63 acts as an end stop.

The engaging end 66 of the first locking element 64 has a locking section 70 and a release section 71. The locking section 70 comprises two parts first and second locking section parts 70*a*, 70*b*. The first and second locking section parts 70*a*, 70*b* are disposed on either side of the release section 71. Although the locking section 70 comprises first and second locking section parts 70*a*, 70*b* in the present arrangement, it will be understood that in an alternative arrangement a single locking section part or another number of locking section parts may be used.

Each locking section part 70*a*, 70*b* is a protruding tab which is arranged to protrude from the mounting face 54. Each locking section part 70*a*, 70*b* has a free end. A locking face 72 distends away from the free end. The locking face 72 extends at an oblique angle to the direction of movement of the first locking element 64.

The release section 71 of the first locking element 64 is provided between the locking section parts 70*a*, 70*b*. The release section 71 extends beyond the locking section 70. That is, the release section 71 protrudes from the free end of the locking section 70. The release section 71 forms a release tab. Therefore, when a force acts on the release section, the locking section 70 is urged to retract in a direction into the aperture 63.

The second locking element 65 has an engaging or front end 73 and a support or rear end 74. The engaging end 73 of the second locking element 65 extends from the aperture 63. That is, during use, the engaging end 73 of the second locking element 65 is arranged to normally protrude from the mounting face 54 of the mounting unit 50. The support end 74 of the second locking element 65 is disposed in the aperture 63. The support end 74 of the second locking element 65 is received between a section of the side surface of the aperture 63 and the first locking element 64. Therefore, the second locking element 65 is supported and guided in the aperture 63.

A limiter (not shown) is provided on the support end 74 of the second locking element 65. The limiter (not shown) is provided to limit movement of the second locking element 65. That is, the limiter limits the extent to which the engaging end 73 of the second locking element 65 is able to protrude from the mounting face 54. The limiter abuts against the inner end 69 of the aperture 63 to determine the maximum extension of the second locking element 65 from the mounting face 54. It will be understood that the limiter moves away from the inner end 69 of the aperture 63 when the engaging end 73 of the second locking element 65 is retracted towards the aperture 63. In the present arrangement, the limiters are protrusions extending from the respective first and second locking elements 64, 65.

The engaging end 73 of the second locking element 65 has a locking section 75 and a release section 76. The locking section 75 comprises two parts first and second locking section parts 75*a*, 75*b*. The first and second locking section parts 75*a*, 75*b* are disposed on either side of the release section 76. Although the locking section 75 of the second locking element 65 comprises first and second locking section parts 75*a*, 75*b* in the present arrangement, it will be understood that in an alternative arrangement a single locking section part or another number of locking section parts may be used.

Each locking section part 75*a*, 75*b* of the second locking element 65 is a protruding tab which is arranged to protrude from the mounting face 54. Each locking section part 75*a*, 75*b* of the second locking element 65 has a free end. A locking face 77 of the second locking element 65 distends away from the free end. The locking face 77 extends at an oblique angle to the direction of movement of the second locking element 65.

The release section 76 of the second locking element 65 is provided between the locking section parts 75*a*, 75*b*. The release section 76 extends beyond the locking section 75. That is, the release section 76 protrudes from the free end of the locking section 75 of the second locking element 65. The release section 76 forms a release tab. Therefore, when a force acts on the release section 76, the locking section 75 of the second locking element 65 is urged to retract in a direction into the aperture 63.

The first and second locking elements 64, 65 are elongate. That is, the engaging end 66, 73 of each of the first and second locking elements 64, 65 are elongate. The engaging ends of the first and second locking elements 64, 65 extend parallel to each other and extend perpendicular to the longitudinal axis of the handle portion. The engaging ends 66, 73 extend across the path of movement of the cutting guide 40 along the handle portion 30. The engaging ends 66, 73 of the first and second locking elements 64, 65 extend perpendicular to the mounting recesses 57 formed by the mounting rail 51.

The release section 71 of the first locking element 64 lies adjacent to the release section 76 of the second locking element 65. Similarly, the locking section 70 of the first locking element 64 lies adjacent to the locking section 75 of the second locking element 65. Therefore, the release sections and the locking sections are aligned with each other, and edges of the locking sections and the release sections are aligned.

The first and second locking elements 64, 65 and the aperture 63 are configured so that the first and second locking elements 64, 65 are able to slide relative to the handle portion 30 along one plane only. The first and second locking elements 64, 65 are configured to slide in a radial direction to the longitudinal axis of the handle portion 30. The first and second locking elements 64, 65 are urged in a direction out of the aperture 63 by an urging unit or mechanism 80 (refer to FIG. 2). The urging unit 80 comprises a first urging member 81 arranged to act on the first locking element 64 and a second urging member 82 arranged to act on the second locking element 65. The first and second urging members 81, 82 are resilient.

The first urging member 81 is a pair of resilient arms. One end of each arm locates against and acts on the support end 67 of the first locking element 64. The first urging member 81 is configured to urge the first locking element 64 to slide from the aperture 63. That is, the first urging member 81 urges the engaging end 73 of the first locking element 64 to protrude from the aperture 63. As described above, the range of movement of the first locking member 64 is restricted by the limiter 68. However, it will be understood that the urging member 81 may act as a limiting means.

Similarly, the second urging member 82 is a pair of resilient arms. One end of each arm locates against and acts on the support end 74 of the second locking element 65. The second urging member 82 is configured to urge the second locking element 65 to slide from the aperture 63. That is, the second urging member 82 urges the engaging end 73 of the second locking element 65 to protrude from the aperture 63. As described above, the range of movement of the second locking member 65 is restricted by the limiter. However, it will be understood that the urging member 82 may act as a limiting means.

In the present embodiment, the first and second urging members 81, 82 are integrally formed, however, it will be understood that they may be separate. The first and second urging members act on the first and second locking elements 64, 65 independently of each other.

The cutting guide 40 is mounted to the handle portion 30 of the body 11 by the mounting unit 50. The second mounting part 52 of the mounting unit 50 is on the cutting guide 40, and slidably mounts to the first mounting part 51 on the handle portion 30. The second mounting part 52 comprises a channel 45 formed on the mounting portion 41. The channel 45 is formed in a rear side of the mounting portion 41. The channel 45 has a base 46 and opposing side walls 47. The side walls 47 extend parallel, but spaced from, each other. The channel base 46 extends between the side walls 47. The channel 45 is elongate.

The mounting rail 53 of the first mounting part 51 is receivable in the channel 45 of the second mounting part 52. The width of the channel 45 corresponds to the width of the mounting rail 53 between the ends of the mounting flanges 48 on the rail 53. The depth of the channel 45 corresponds to the height of the mounting rail 53.

The channel 45 is open at one end and has an end wall (not shown) at the other end. Therefore, it is possible to slide the mounting rail 53 along the channel 45 from the open end of the channel 45. The end wall acts as an end stop to limit movement of the mounting rail 53 along the channel 45, and therefore movement of the cutting guide 40 along the handle portion 30.

Mounting flanges 48 extend from each of the side walls 47. The mounting flanges 48 are spaced from the channel base 46. The distance between each mounting flange 48 and the base 46 of the channel 45 corresponds to the thickness of the mounting ridges 56 formed on the mounting rail 53. Therefore, the mounting flanges 48 of the second mounting part 52 are slidably receivable in the mounting recesses 57 of the first mounting part 52. The mounting ridges 56 are slidably receivable between the mounting flanges 48 of the second mounting part 52 and the base 46 of the channel 45 when the mounting rail 53 is slid along the channel 45. Therefore, the cutting guide 40 is restrained to slide along a path in plane of movement when the first and second mounting parts 51, 52 are slidably attached to each other.

The cutting guide 40 is secured in position on the handle portion 30 by the locking unit 60. The second locking part 62 of the locking unit is on the cutting guide 40, and releasably engages with the first locking part 61 on the handle portion 30. The second locking part 62 comprises a plurality of receiving recesses 83. The receiving recesses 83 are formed in the base 46 of the channel 45. The receiving recesses 83 are arranged parallel to each other. The receiving recesses 83 are arranged in a linear arrangement.

Adjacent receiving recesses 83 are separated by a receiving ridge 84. Therefore, each receiving recess 83 is bounded by two receiving ridges 84. An upper end of each ridge 84 lies planar with the plane of the base 46 of the channel 45.

In the present arrangement the centres of adjacent receiving recesses are spaced about 2 mm apart from each other. Similarly, the centres of adjacent ridges 84 are spaced about 2 mm apart from each other. Therefore, the distance between the centre of one receiving recess 83 and one of the adjacent receiving ridges 84 is about 1 mm.

Each receiving recess 83 has two side walls 85 and a base 86. The recess side walls 85 diverge from the recess base 86 to the opening of the receiving recess 83 (not shown in FIG. 10 and onwards). Therefore, the side walls extend at an oblique angle to the channel base 46. The diverging shape acts to ease location of the locating elements 64, 65 in the corresponding receiving recess 83. Each receiving recess 83 is configured to receive one of the locking elements 64, 65. That is, each receiving recess 83 is arranged to receive a single locking element 64, 65 at a time. However, each receiving recess 83 is able to alternately receive the first and second locking elements 64, 65.

The locking unit 60 also has a release unit 90. The release unit 90 comprises a release member 91. The release member is elongate. The release member 91 is on the cutting guide 40. The release member 91 is received in a cavity 92 formed in the base 46 of the channel 45. The release unit 90 is provided in the middle of the receiving recesses 83. That is, release unit 90 separates each receiving recess 83 into two recess parts 83*a*, 83*b*. The release member 91 is disposed between the two recess parts 83*a*, 83*b*. The width of the release member 91 corresponds to the width of the release section 71, 76 of each of the first and second locking elements 64, 65 respectively. The width of each of the recess parts 83*a*, 83*b* corresponds to the width of each of the corresponding locking section parts 70*a*, 70*b*, 75*a*, 75*b* of the first and second locking elements 64, 65.

The release member 91 is pivotably mounted in the cavity 92. That is, the release member is hinged about one of a top or a bottom end to the base 46 of the channel 45 (hinge not shown for clarity). The release member 91 is pivotable between a retracted position and an operating position. The release member 91 is biased towards its retracted position. In the retracted position, the release member 91 is retracted in the cavity 92. In the operating position, the release member is displaced in a direction out of the cavity 92. That is, the release member 91 is displaced towards and/or from the base 46 of the channel 45. The release member 91 is arranged to urge the first and second locking elements 64, 65 from an engaged condition, in which one of the locking elements 64, 65 is received in one of the receiving recesses 83, and a disengaged condition, in which the locking elements 64, 65 are urged out of the receiving recesses 83.

The release member 91 has a release face 93. The release face 93 faces out of the cavity 92. On the other side of the release member 91 is a button 94. The button 94, acting as a user input element, extends through a hole in the cutting guide 40. The button 94 protrudes from an outer side of the cutting guide 40. Therefore, the button is accessible when the cutting guide 40 is slidably mounted to the handle portion 30. The button 94 is provided to enable an actuating force to be applied to the release member 91 to urge it to move from its retracted position into its operating position.

A plurality of indents 95 are formed on the release face 93 of the release member 91. The plurality of indents 95 extend parallel to each other. The indents 95 are aligned with each receiving recesses 83 and act as alignment elements. The indents 95 act to align the locking elements 64, 65 with the receiving recesses 83. The indents 95 have a shallower depth than the receiving recesses 83. Therefore, the locking elements 64, 65 are able to slide out of and over the indents as the cutting guide 40 is slid along the body 11 without an undue force being required.

In use, the cutting guide 40 is slidably mounted to the handle portion 30 by the mounting unit 50. The mounting rail 53 on the handle portion 30 is received in the channel 45 on the cutting guide 40. The mounting rail 53 is slid into the channel from the open end of the channel 45. The mounting ridges 56 are slidably received between the mounting flanges 48 of the second mounting part 52 and the base 46 of the channel 45. The mounting rail 53 is then able to slide in the channel 45.

The first and second locking elements 64, 65 initially protrude from the mounting face 54 of the mounting rail 53. That is, the locking sections 70, 75 and release sections 71, 76 of the locking elements 64, 65 extend from the aperture 63. The first and second urging members 81, 82 of the urging unit 80 act on the first and second locking elements 64, 65 to bias the locking elements 64, 65 to extend from the aperture 63. As the mounting rail 53 is slid into the channel 45, the base 46 of the channel 45 overlaps the mounting face 54 of the mounting rail 53. The base 46 of the channel 45 therefore acts on the first and second locking elements 64, 65 to urge the locking elements 64, 65 to retract in a direction towards the aperture 63. That is, the first and second locking elements 64, 65 are in their disengaged condition, but are biased against the base 46 of the channel 45. The locking sections 70, 75 of each of the first and second locking elements 64, 65 abut against the channel base 46. The release section 71, 76 of each of the first and second locking elements 64, 65 is received in the cavity 92 in the base 46 of the channel 45. It will be understood that the release member 91 of the release unit 90 is initially biased into its refracted position. Therefore, the release member 91 does not act on the first and second locking elements 64, 65 at this stage.

As the cutting guide 40 is further slid along the handle portion 30, the first and second locking elements 64, 65 slide along the base of the channel 45 until the first locking element 64 reaches the first receiving recess 83*a*. The first locking element 64 is then moved over the first receiving recess 83*a*. At this stage, the first urging member 81 biases the first locking element 64 to slide into the receiving recess 83. The first locking element 64 moves from its disengaged condition into its engaged condition. Therefore, the locking section 70 of the first locking element 64 locates in the first receiving recess 83*a*. The converging side walls 85 of the recess 83 aid location of the first locking element 64 therein.

When the locking section 70 of the first locking element 64 is received in the first receiving recess 83*a*, the release section 71 moves towards the release member 91. However, the release unit 90 is initially biased into its retracted position and so does not prevent the locking section 70 of the first locking element 64 from being received in the first receiving recess 83*a*. The first locking element 64 is maintained in its engaged condition due to the action of the first urging member 81.

The locking unit 60 therefore prevents movement of the cutting guide 40 relative to the body, and therefore the blade portion 20. The head portion 42 extends over the blade portion 20. The cutting guide 40 is then in a first discrete locked position. That is, the position of the cutting guide 40 is fixed in a first locked position relative to the cutting blade assembly to provide a cutting distance from a user's skin to enable hair to be cut to a desired length.

It will be understood that each of the receiving recesses 83 are configured to receive a single locking element 64. Therefore, when the first locking element 64 is received in the receiving recess 83*a*, the second locking element 65 is retained on the base 46 of the channel 45. That is, the channel base 46 adjacent to the first receiving recess 83*a* acts as a receiving ridge 84. The locking section 75 of the second locking element 65 abuts the receiving ridge 84 and so is prevented from moving into an engaged condition.

Figure 10:
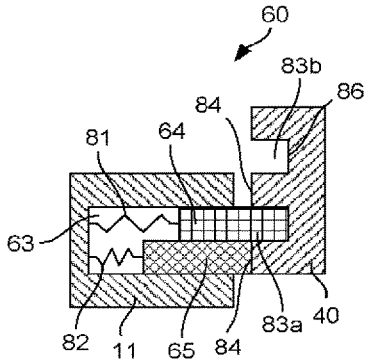
FIG. 10 shows a diagrammatic cross-sectional side view of a locking unit of the hair trimming device shown in FIG. 1 in a first locking position.
Figure 11:
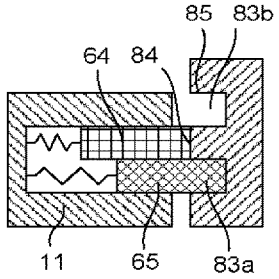
FIG. 11 shows a diagrammatic cross-sectional side view of the locking unit shown in FIG. 10 in a second locking position.
Figure 12:
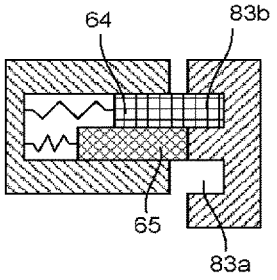
FIG. 12 shows a diagrammatic cross-sectional side view of the locking unit shown in FIG. 10 in a third locking position.

Diagrammatic views of the locking unit 60 are shown in FIGS. 10 to 12. In FIG. 10, the locking unit 60 is shown with the first locking element 64 received in the first receiving recess 83*a*. The second locking element 65 is located against the first receiving ridge 84. It will be understood that movement of the cutting guide 40 is therefore restricted.

Figure 16:
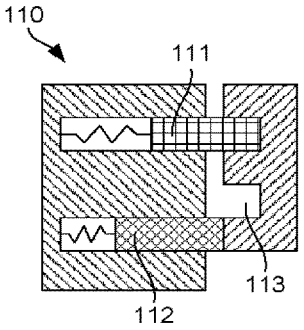
FIG. 16 shows a diagrammatic cross-sectional side view of another embodiment of a locking unit of the hair trimming device shown in FIG. 1 in a first locking position.
Figure 18A:
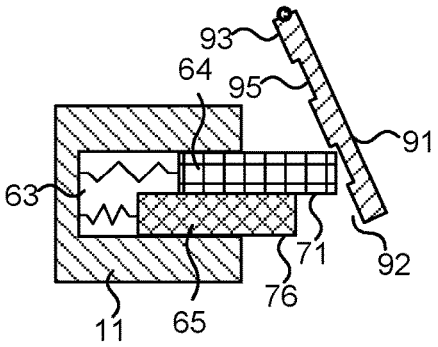
FIG. 18A shows a diagrammatic cross-sectional side view of a release unit shown in FIGS. 4 and 5 in a retracted position.
Figure 18B:
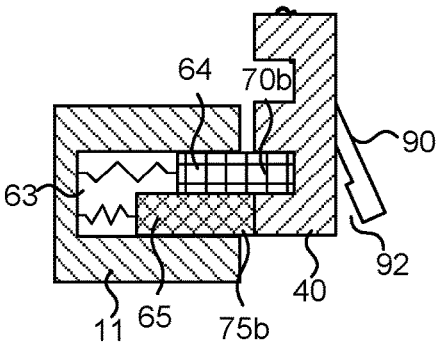
FIG. 18B shows a diagrammatic cross-sectional side view of the locking unit shown in FIG. 10 with the release unit shown in the retracted position of FIG. 18A.
Figure 19A:
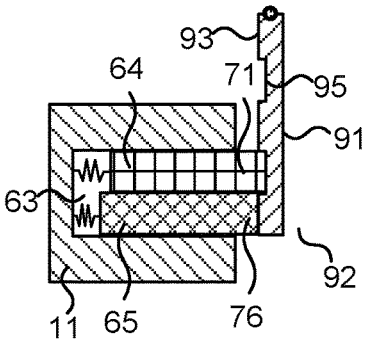
FIG. 19A shows a diagrammatic cross-sectional side view of the release unit shown in FIGS. 4 and 5 in an operating position.
Figure 19B:
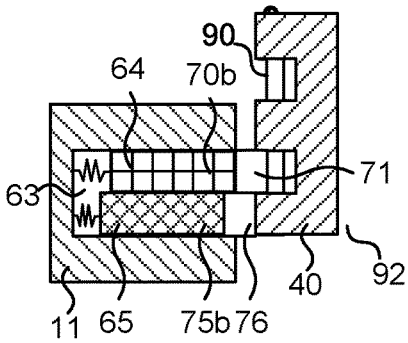
FIG. 19B shows a diagrammatic cross-sectional side view of the locking unit shown in FIG. 10 with the release unit shown in the operating position of FIG. 18A.

To adjust the position of the cutting guide 40 relative to the cutting blade assembly, a user exerts a force on the button 94. The release member 91 of the release unit 90 is urged from a retracted position as shown in FIGS. 18A and 18B towards the first and second locking elements 64, 65 in an operating position as shown in FIGS. 19A and 19B. Specifically, the release face 93 is brought into contact with the release section 71 of the first locking element 64 extending into the cavity 92. The release member 91 then acts on the release section 71 of the first locking element 64 to urge the first locking member 64 to move towards its disengaged condition. That is, the locking section 70 of the first locking element 64 is retracted from the first receiving recess 83*a* as shown in FIG. 16. When the first locking element 64 disengages from the receiving recess 83*a*, the cutting guide 40 is able to slide along the handle portion 30. The release member 91 also acts on the release section 76 of the second locking element 65 to maintain the second locking member 65 in its disengaged condition. That is, the first and second locking elements 64, 65 are unable to locate in the receiving recesses whilst the release member 91 acts on them and prevents them moving into an engaged condition as shown in FIGS. 19A and 19B.

As the cutting guide 40 is slid along the handle portion 30 and the button 94 is depressed, the release sections 71, 76 of the first and second locking elements 64, 65 are biased against the release face 93 of the release member 91. Therefore, the locking elements 64, 65 locate against and move over the indents 95 formed in the release face 93. The indents 95 are formed to have a shallow profile so that a user is not required to exert an undue force to cause the locking elements 64, 65 to slide from the indents 95. The indents 95 act to provide tactile feedback to a user and aid the user to locate the desired position for the cutting guide 40 relative to the blade portion 20. It will also be understood that the indents 95 are aligned with the receiving recesses 83 to aid alignment of each of the locking elements 64, 65 with the receiving recesses 83.

If a user wants to move and lock the cutting guide 40 in a position along the body 11 by a single discrete position, that is the smallest distance that the locking unit is able to lock the cutting guide 40 relative to the body 11, the cutting guide 40 is slid along the handle portion 30 from its first locked position. It will be understood that in the present arrangement the distance between discrete positions is about 1 mm.

When the cutting guide 40 is disposed in its second discrete position, the user releases the button 94. The release member 91 then moves from its operating position to its retracted position away from the first and second locking elements 64, 65. The first and second locking elements 64, 65 are then urged to move into their engaged conditions. The second locking element 65 is able to locate in the first receiving recess 83*a*, and the first locking element 64 abuts against the adjacent receiving recess 84. Such a position is shown in FIG. 11. Therefore, it is not necessary for the first locking element 64 to move to the next receiving recess in order for the locking unit to engage in a locked condition.

If a user wants to move and lock the cutting guide 40 along the body 11 by another single discrete position, then the release unit 90 is operated by the user and the cutting guide 40 slid along the body 11 by the required distance. The release unit 90 is then released. The first locking element 64 is then able to locate in a second receiving recess 83*b*, and the second locking element abuts against the adjacent receiving ridge 84. Such a position is shown in FIG. 12.

It will be understood that the cutting guide 40 is able to be positioned and locked in a number of positions due to the plurality of receiving recesses 83 formed on the cutting guide. With the above described arrangement, it will be understood that the cutting guide 40 may be moved by more than a single discrete position each time the release unit 90 is operated.

Figure 13:
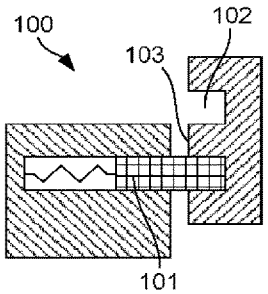
FIG. 13 shows a diagrammatic cross-sectional side view of another locking unit shown for reference only in a first locking position.
Figure 14:
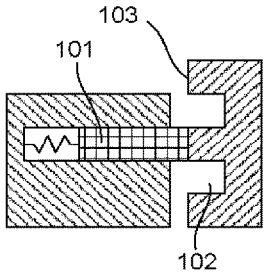
FIG. 14 shows a diagrammatic cross-sectional side view of the locking unit shown in FIG. 17 for reference only in an intermediate position.
Figure 15:
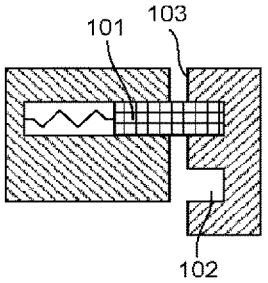
FIG. 15 shows a diagrammatic cross-sectional side view of the locking unit shown in FIG. 17 for reference only in a second locking position

In FIGS. 13 and 15, a locking unit 100 with a single locking element 101 only is shown. The arrangement shown in FIGS. 13 to 15 is shown for illustrative purposes only. In this arrangement receiving recesses 102 are provided with the same arrangement and spacing as the receiving recesses in the above arrangement. Receiving ridges 103 are formed adjacent to each receiving recess 102. It will be understood that in this arrangement the cutting guide may only be disposed in a locked condition when the locking element 101 is aligned with one of the recesses 102. Therefore, the distance between locked positions is equal to the distance between the centre of each recess, as shown in FIGS. 13 to 15. On the contrary, with the arrangement shown in FIGS. 10-12, the distance between locked positions is equal to half the distance between the centre of each recess 102. The above arrangement with two locking elements therefore provides twice the number of discrete locking positions for a set number of recesses compared to an arrangement with a single locking element. Therefore, the distance between locking positions may be halved. Furthermore, the rigidity of a locking unit may be maximized by allowing the recesses and locking elements to be maximized for a set distance between locking positions.

Figure 17:
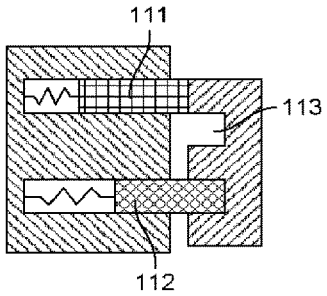
FIG. 17 shows a diagrammatic cross-sectional side view of the locking unit shown in FIG. 16 in a second locking position.

Although in the above described embodiments the first and second locking elements are disposed adjacent to each other, it will be understood that in an alternative arrangement the first and second locking elements may be spaced from each other. Referring now to FIGS. 16 and 17, a locking unit 110 of another embodiment of a hair trimming device is shown. The hair trimming device of this embodiment is generally the same as the hair trimming devices described above, and so a detailed description of the hair trimming device will be omitted herein.

The locking unit 110 shown in FIGS. 16 and 17 has a first locking element 111 and a second locking element 112. The first and second locking elements 111, 112 are spaced apart by twice the width of a single locking element from each other. Alternatively, it will be understood that the first and second locking elements may be spaced a multiple of twice the width of a single locking element from each other. This arrangement is provided to ensure that one of the locking elements is in a disengaged position when the other locking element is received in a receiving recess 113.

It will be understood that, when the cutting guide is moved a single discrete position along the body of the device, the second locking element engages in a different receiving recess to the receiving recess in which the first locking element was received. However, it will be understood that the first locking element locates against one of the receiving ridges. An advantage of this arrangement is that the first and second locking elements are spaced from each other, and do not slide against one another. Therefore, if one of the locking elements is prevented from moving into an engaged condition it will not act on the other locking element, which will still be able to function.

Although in the above described embodiments the first locking part with the locking elements is disposed on the body and the second locking part with the receiving recesses is disposed on the cutting guide, it will be understood that in an alternative arrangement the first locking part may be disposed on the cutting guide with the second locking part disposed on the body.

Although in the above described embodiments a release unit is provided to enable the locking elements to disengage from the locking unit, it will be understood that in an alternative arrangement the release unit may be omitted. In such an arrangement, a lateral force acting on the locking element received in the corresponding recess due to a user urging the cutting guide to slide relative to the body of the device is sufficient to urge the locking element into a disengaged condition. This may be achieved by providing the receiving recesses with angled side walls and/or a shallow depth.

Although in the above embodiments the locking unit is provided with first and second locking elements, it will be understood that the arrangement is not limited thereto. For example, the locking unit may be provided with a third locking element. In such an arrangement, the third locking element is arranged to locate in one of the receiving recesses when one of the first or second locking elements locates in the or another of the receiving recesses. Similarly, in another arrangement the locking unit is provided with a third locking element and a fourth locking element. In such an arrangement, the third locking element is arranged to locate in one of the receiving recesses when the first locking elements locates in the or another of the receiving recesses and the fourth locking element is arranged to locate in one of the receiving recesses when the second locking elements locates in the or another of the receiving recesses.

It will be appreciated that the term "comprising" does not exclude other elements or steps and that the indefinite article "a" or "an" does not exclude a plurality. A single processor may fulfill the functions of several items recited in the claims. The mere fact that certain measures are recited in mutually different dependent claims does not indicate that a combination of these measures cannot be used to an advantage. Any reference signs in the claims should not be construed as limiting the scope of the claims.

Although claims have been formulated in this application to particular combinations of features, it should be understood that the scope of the disclosure of the present invention also includes any novel features or any novel combinations of features disclosed herein either explicitly or implicitly or any generalization thereof, whether or not it relates to the same invention as presently claimed in any claim and whether or not it mitigates any or all of the same technical problems as does the parent invention. The applicants hereby give notice that new claims may be formulated to such features and/or combinations of features during the prosecution of the present application or of any further application derived therefrom.

The invention claimed is:

1. A hair trimming device comprising:

a body with a cutting blade assembly, a cutting guide on the body, the position of the cutting guide being adjustable relative to the cutting blade assembly to provide a cutting distance from a user's skin to enable hair to be cut to a desired length, and a locking unit to lock the cutting guide at a desired position relative to the cutting blade assembly, wherein the locking unit comprises a first locking element, a second locking element and a plurality of receiving recesses, wherein a ridge is formed between adjacent receiving recesses of the plurality of receiving recesses, wherein the first and second locking elements are movable relative to each other to alternately locate in the receiving recesses when the position of the cutting guide is adjusted relative to the cutting blade assembly to lock the cutting guide at different positions, and wherein the first and second locking elements are alternately locatable on one of the ridges when the other of the first and second locking elements is received in one of the receiving recesses, such that only one of the first and second locking elements is receivable in one of the receiving recesses at a time, when the cutting guide is locked at a desired position.

2. A hair trimming device according to claim 1, wherein the first and second locking elements are adjacent to each other and are alternately receivable in the receiving recesses as the position of the cutting guide is adjusted relative to the cutting blade assembly to lock the cutting guide at different positions.

3. A hair trimming device according to claim 1, wherein the first and second locking elements are spaced from each other and are alternatively receivable in different receiving recesses of the plurality of recesses as the position of the cutting guide is adjusted relative to the cutting blade assembly to lock the cutting guide at different positions.

4. A hair trimming device according to claim 1, wherein the first and second locking elements are received in an aperture, and an urging unit acts on the first and second locking elements to urge the first and second locking elements to protrude from the aperture.

5. A hair trimming device according to claim 1, further comprising a release unit configured to selectively urge the first and second locking elements out of the receiving recesses.

6. A hair trimming device according to claim 5, wherein the release unit comprises a release face configured to act on the first and second locking elements, the release unit being movable between an operating position and a retracted position; and wherein the release face acts on the first and second locking elements to urge the first and second locking elements out of the receiving recesses.

7. A hair trimming device according to claim 6, wherein the release face of the release unit extends recessed from a base of the receiving recesses when the release unit is in the retracted position.

8. A hair trimming device according to claim 6, wherein the release face has one or more alignment elements formed thereon.

9. A hair trimming device according to claim 8, wherein the alignment elements are configured to allow the locking elements to slide along the release face when the release unit is in the operating position.

10. A hair trimming device according to claim 6, wherein the release face of the release unit extends level with a base of the receiving recesses when the release unit is in the retracted position.

11. A hair trimming device according to claim 5, wherein the first and second locking elements each have a locking section and a release section, where each locking section is configured to alternately locate in the receiving recesses when the position of the cutting guide is adjusted relative to the cutting blade assembly to lock the cutting guide at different positions, and wherein each release section is configured to be against the release unit in the operating position.

12. A hair trimming device according to claim 1, wherein the first and second locking elements are on the body and the at least one receiving recess is on the cutting guide.

13. A hair trimming device according to claim 1, wherein the locking unit is configured to lock the cutting guide in two or more discrete positions.

14. A hair trimming device according to claim 13, wherein the two or more discrete positions are spaced equal to or less than 2 mm, preferably about 1 mm.

15. A hair trimming device according to claim 1, wherein the first and second locking elements are independently movable relative to each other to alternately locate in the receiving recesses when the position of the cutting guide is adjusted relative to the cutting blade assembly to lock the cutting guide at different positions.

* * * * *